US007165334B2

(12) United States Patent
Ben-Gigi

(10) Patent No.: US 7,165,334 B2
(45) Date of Patent: Jan. 23, 2007

(54) GUIDE CLAMP

(75) Inventor: Zion Ben-Gigi, Kfar Veradim (IL)

(73) Assignee: Tefentools Ltd., Tefen (IL)

( * ) Notice: Subject to any disclaimer, the term of this patent is extended or adjusted under 35 U.S.C. 154(b) by 0 days.

(21) Appl. No.: 11/097,150

(22) Filed: Apr. 4, 2005

(65) Prior Publication Data

US 2005/0217128 A1 Oct. 6, 2005

(51) Int. Cl.
*B43L 7/00* (2006.01)

(52) U.S. Cl. ..... 33/485; 33/443; 33/446

(58) Field of Classification Search ..... 33/485, 33/446, 437, 443; 269/42–43, 166, 221; 83/745

See application file for complete search history.

(56) References Cited

U.S. PATENT DOCUMENTS 4,490,920 A * 1/1985 Griset ..... 33/443
4,872,709 A * 10/1989 Stack ..... 285/39
5,348,276 A * 9/1994 Blacker ..... 269/88
5,964,041 A * 10/1999 Daniel ..... 33/403
6,591,728 B1 * 7/2003 Grondahl ..... 83/743
6,622,997 B1 * 9/2003 Emerson ..... 269/166
6,665,947 B1 * 12/2003 Kirkland ..... 33/640

* cited by examiner

*Primary Examiner*—Yaritza Guadalupe McCall
(74) *Attorney, Agent, or Firm*—Dekel Patent Ltd.; David Klein

(57) ABSTRACT

A guide clamp including a generally, straight elongate guide bar, a first clamp assembly mounted at one end of the guide bar, a second clamp assembly slidingly mounted along the guide bar, the clamp assemblies being adapted to clamp a workpiece therebetween, an end cap affixed to an opposite end of the guide bar, wherein at least one of the clamp assemblies includes a clamp body that is pivotable with respect to the guide bar.

8 Claims, 6 Drawing Sheets

GUIDE CLAMP

FIELD OF THE INVENTION

The present invention relates to tool guiding and marking devices and more particularly to guides and markers which are clamped to a workpiece and the like.

BACKGROUND OF THE INVENTION

Guide clamps are tools that may be clamped to a workpiece or workbench and the like, for guiding a saw or other cutting tool, for cutting wood and the like.

The basic features of a guide clamp include a guide bar having a pair of gripping jaws at one side of the bar to clamp onto a workpiece, such as a board. One jaw, the clamping jaw, is at one end of the bar. The other jaw, the shifting jaw, may be positioned along the reach of the bar to bring the jaws against the edges of the workpiece to clamp the workpiece. The guide clamp may be used for various purposes, such as but not limited to, making markings on the workpiece, or as an abutment for a power hand saw which is held against the guide clamp as it makes a cut across the workpiece.

However, certain guide clamps are not always satisfactory for serving as an abutment for other types of power hand tools, such as a router. The vibration and other action of such a tool can move the tool away from the edge of the guide clamp even when it is tightly held.

U.S. Pat. No. 4,394,800 to Griset, the disclosure of which is incorporated herein by reference, describes an improved guide clamp, which positively holds and guides a tool across the workpiece. In this clamp, the shifting jaw is slidably carried on the guide bar to permit the workpiece to be embraced by the jaws. A pull rod associated with and parallel to the guide bar is connected to a lever on the clamp jaw. The shifting jaw locks onto this pull rod when the jaws embrace a workpiece and actuation of the lever then pulls the jaws together to clamp onto the workpiece and hold the guide clamp thereon. Guideways to guide and hold tools, jigs and the like are provided on the guide bar.

SUMMARY OF THE INVENTION

The present invention seeks to provide a guide clamp that improves upon the guide clamp of U.S. Pat. No. 4,394,800 to Griset, as is described in detail further hereinbelow.

There is thus provided in accordance with an embodiment of the present invention a guide clamp including a generally, straight elongate guide bar, a first clamp assembly mounted at one end of the guide bar, a second clamp assembly slidingly mounted along the guide bar, the clamp assemblies being adapted to clamp a workpiece therebetween, an end cap affixed to an opposite end of the guide bar, wherein at least one of the clamp assemblies includes a clamp body that is pivotable with respect to the guide bar.

The guide clamp may include one or more of the following features. For example, the clamp body may include a pivot member pivotally mounted in a block of the at least one clamp assembly. The clamp body may include a clamp jaw pad received in a clamp jaw receiving member.

In accordance with an embodiment of the present invention, one or more resilient arms may extend from the clamp body, adapted for providing an urging force on that clamp assembly to return that clamp assembly from a pivoted position to a non-pivoted, straight position.

Further in accordance with an embodiment of the present invention, the end cap may be formed with a hanging hole.

Still further in accordance with an embodiment of the present invention dimensional markings may be marked on the guide bar.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
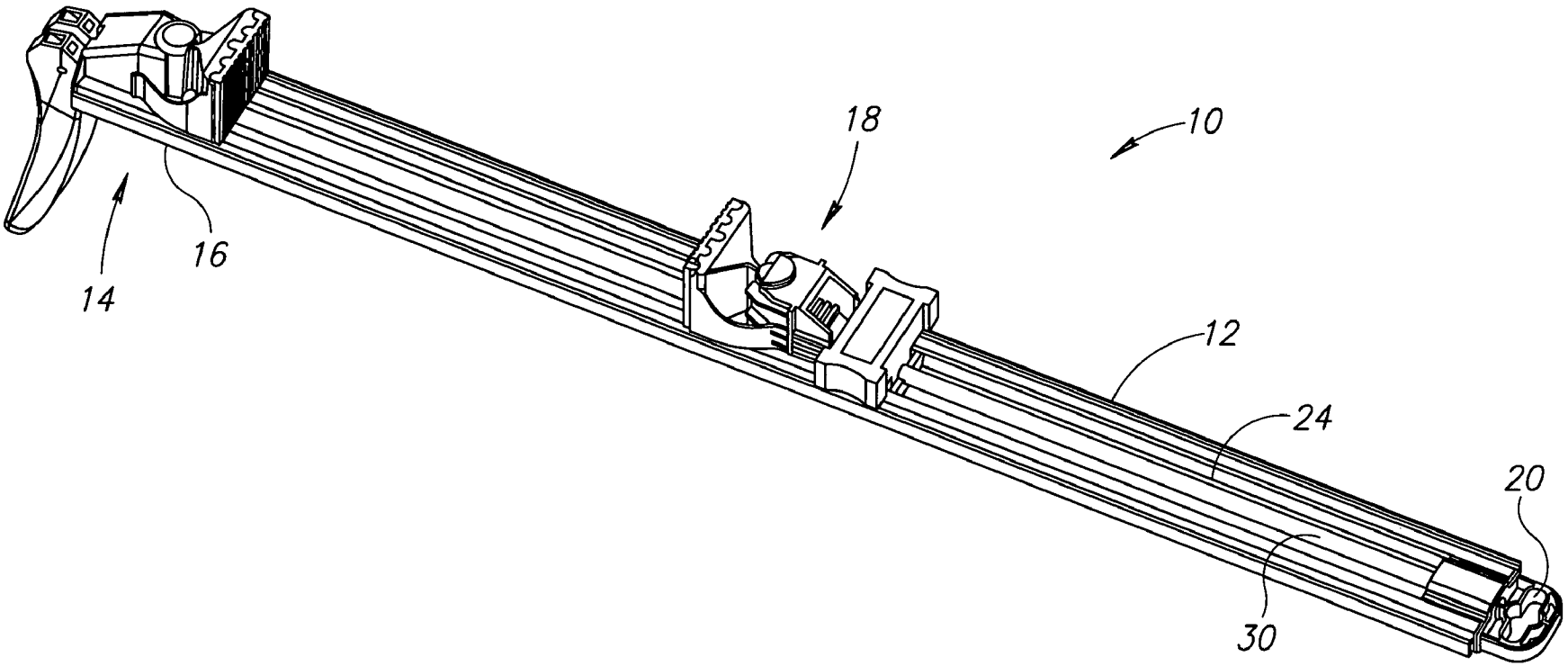
FIG. 1 is a simplified pictorial illustration of a guide clamp, constructed and operative in accordance with an embodiment of the present invention.

Reference is now made to FIG. 1, which illustrates a guide clamp 10, constructed and operative in accordance with an embodiment of the present invention.

Some features of the guide clamp 10 may be constructed as in U.S. Pat. No. 4,394,800, as is now described. Inventive features which are not found in U.S. Pat. No. 4,394,800 are described further below.

As in U.S. Pat. No. 4,394,800, guide clamp 10 may include a generally, straight elongate guide bar 12. Guide bar 12 may be constructed of any sturdy material, such as but not limited to, metal (e.g., cast steel, zinc, stainless steel, aluminum and the like), plastic (e.g., a glass or fiber reinforced engineering plastic), or wood. Guide bar 12, and thus guide clamp 10, may be of any length and size necessary to accommodate and fit upon any workpiece with which it will be used.

Figure 2A:
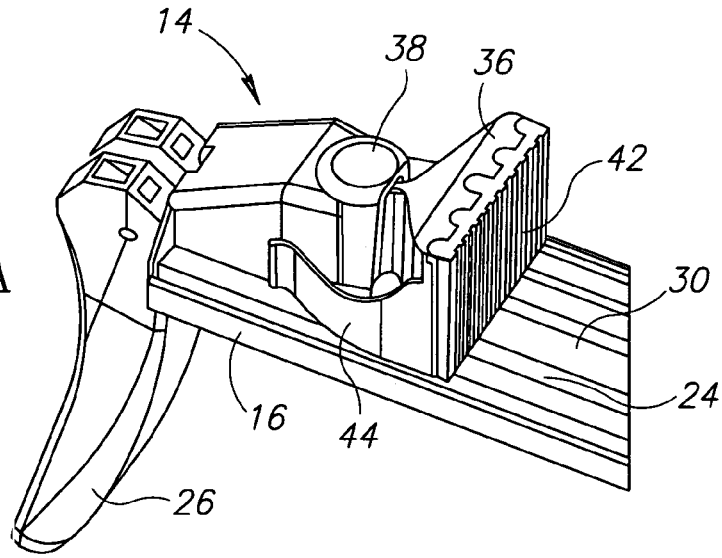
FIGS. 2A, 2B and 2C are simplified pictorial illustrations, respectively, of a first end having a clamp, a slide clamp and a second end provided with an aperture suitable for hanging the guide clamp from a hook and the like, in accordance with another embodiment of the present invention.
Figure 2B:
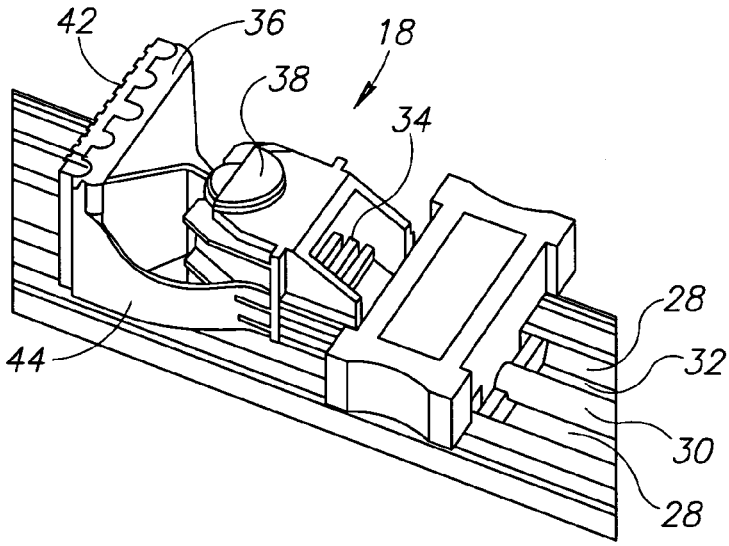

A first clamp assembly 14 may be fixedly or removably mounted at one end 16 of guide bar 12 (seen best in FIG. 2A). A second clamp assembly 18 may be slidingly mounted along guide bar 12 (seen best in FIG. 2B). An end cap 20 may be affixed to an opposite end 22 of guide bar 12 (seen best in FIG. 2C). The first and second clamp assemblies 14 and 18 are arranged to depend from an underside 24 of guide bar 12 for gripping a workpiece (not shown), such as a board, for example. The first and second clamp assemblies 14 and 18 may be spaced from one another by moving the second clamp assembly 18 along guide bar 12, pressing the clamp assemblies 14 and 18 against the workpiece, and then locking the guide clamp 10 upon the workpiece by depressing a lever 26 outstanding from the first clamp assembly 14.

Guide bar 12 may be formed with grooves 28 (FIG. 2B) in which second clamp assembly 18 slides. A pull rod 30 may be disposed in a cavity 32 that extends longitudinally along guide bar 12. Pull rod 30 may pass through the second clamp assembly 18, and connect with the lever 26 of the first clamp assembly 14 and with the end cap 20. The second clamp assembly 18 may include a locking device 34 (which has a releasable catch seen in FIG. 2B) for engaging pull rod 30 and fixing the second clamp assembly 18 at a desired position along pull rod 30. The structure of the lever 26 and the locking device 34 are not part of the invention and are described in U.S. Pat. No. 4,394,800.

The clamp assemblies of the present invention are constructed differently than those of U.S. Pat. No. 4,394,800. Reference is now made additionally to FIGS. 4A–4D. In accordance with an embodiment of the present invention, at least one (preferably both) of the first and second clamp assemblies 14 and 18 includes a clamp body 36 (which may be molded from plastic, for example) that includes a pivot member 38 and a clamp jaw receiving member 40. Pivot member 38 pivotally mounts in a block 40 of the clamp assembly 14 or 18. Pivot member 38 may be constructed as a hollow cylinder into which a pin from the block 40 may be rotatingly disposed. Alternatively, pivot member 38 may be constructed as a pin member that rotatingly fits into a circular groove formed in the block 40.

The clamp jaw receiving member 40 may be constructed with various grooves and/or tenons for mating with a clamp jaw pad 42, which may be made of any suitable material, such as but not limited to, a plastic or an elastomer (e.g., natural or synthetic rubber).

One or more resilient arms 44 may extend from clamp body 36 in a direction away from clamp jaw pad 42 towards the direction of pivot member 38. Resilient arms 44 are shown as being arcuate in shape terminating in a curved lip 46, which rests against block 40 of the clamp assembly 14 or 18. Resilient arms 44 may be constructed of spring steel or of a resilient plastic or elastomeric material, such as types of polyurethane or synthetic rubber. Preferably the resilient arms 44 are molded from plastic as one piece with the rest of clamp body 36.

Figure 3A:
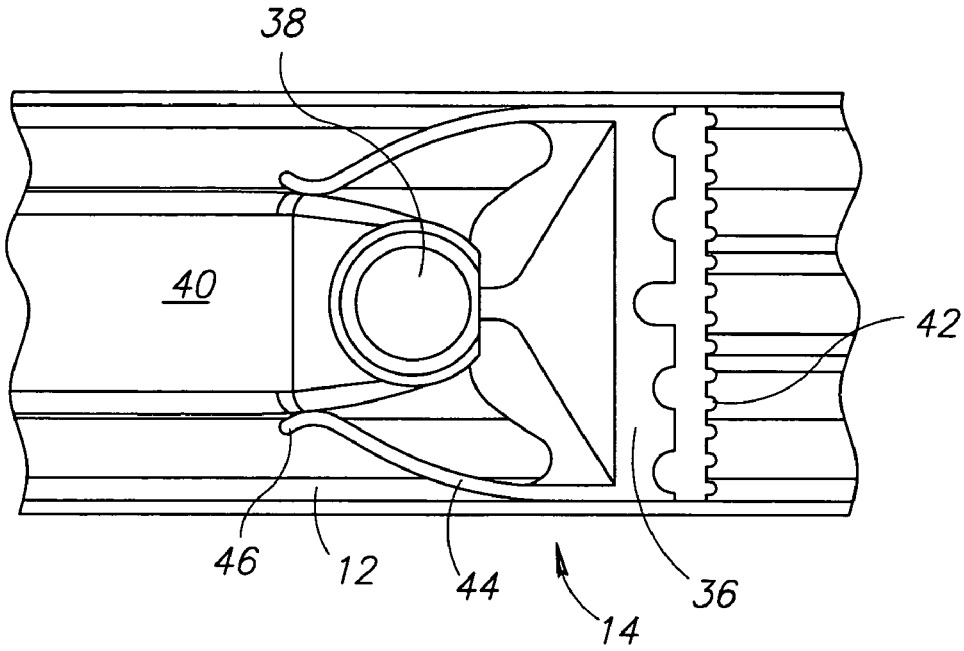
FIGS. 3A and 3B are simplified top-view illustrations of one of the clamps in respective straight and angled positions.
Figure 3B:
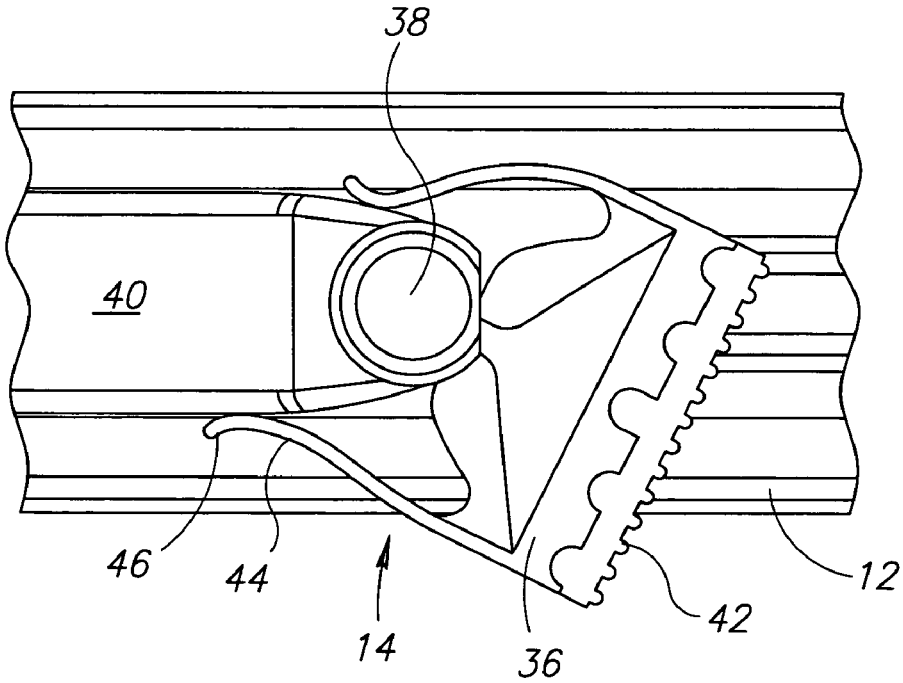
Figure 4A:
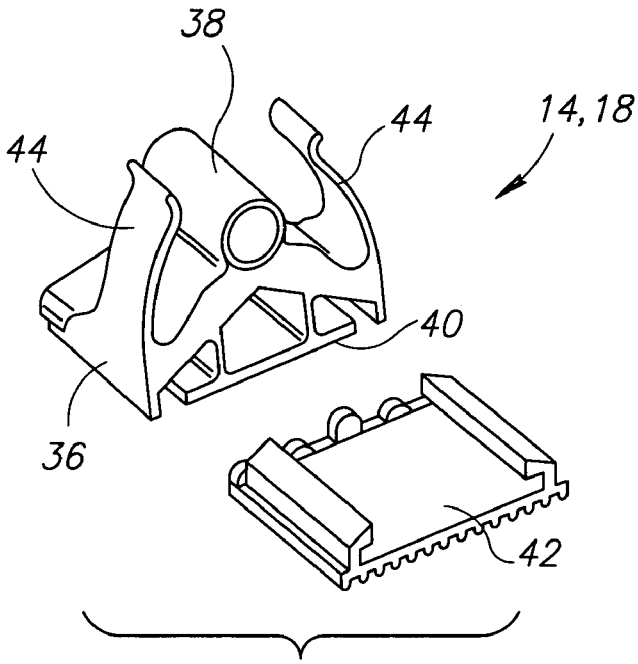
FIGS. 4A, 4B, 4C and 4D are simplified illustrations of an assembly of one of the clamps, FIGS. 4A and 4B being exploded illustrations of a clamp face and clamp body before assembly thereof in two different views, and FIGS. 4C and 4D being perspective illustrations of the clamp face assembled with the clamp body in two different views.
Figure 4B:
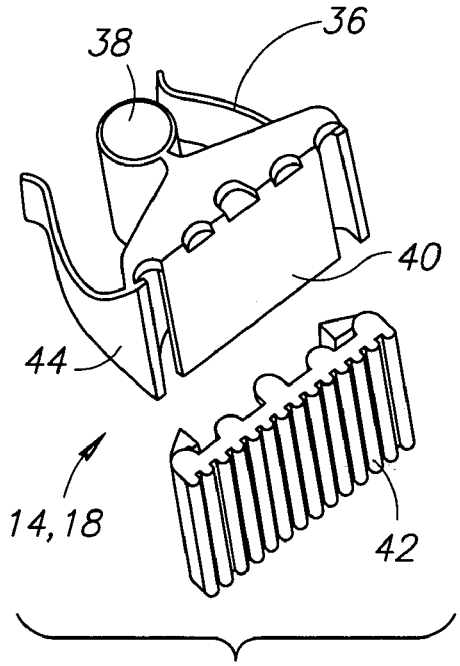
Figure 4C:
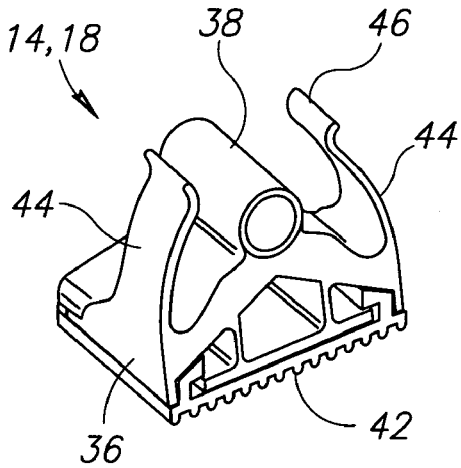
Figure 4D:
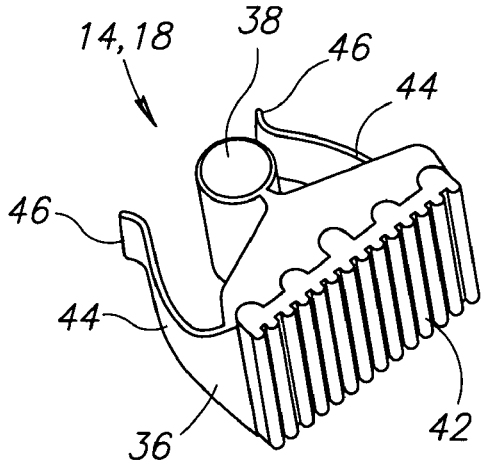

FIG. 3A illustrates clamp assembly 14 in a straight position. FIG. 3B illustrates clamp assembly 14 rotated at an angle about pivot member 38. The clamp assembly 18 may be correspondingly rotated at an angle about its pivot member 38 (not seen in FIG. 3B). A workpiece (not shown) may be clamped between the clamp assemblies 14 and 18 while they are in the rotated position. It is noted that the rotation of clamp assembly 14 may shift the positions of the resilient arms 44 on the block 40 of the clamp assembly 14. The resilience of the arms 44 provides an urging force on the clamp assembly 14 to return the clamp assembly 14 to its straight position after the workpiece is removed from the guide clamp 10.

Figure 2C:
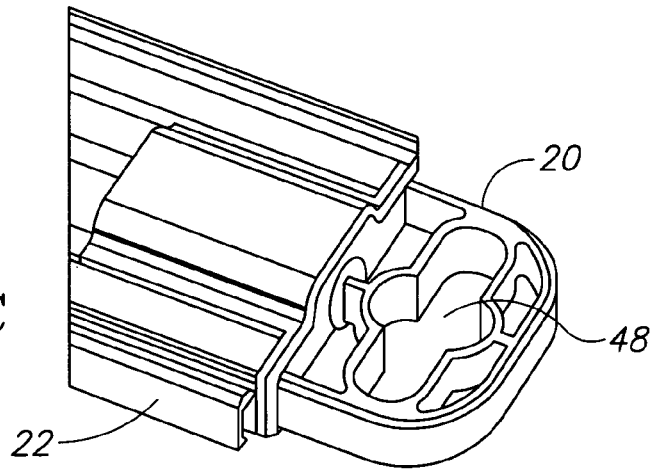

Reference is now made particularly to FIG. 2C. In accordance with an embodiment of the present invention, end cap 20 may be formed with a hanging hole 48, such as but not limited to, a Euroslot.

Figure 5:
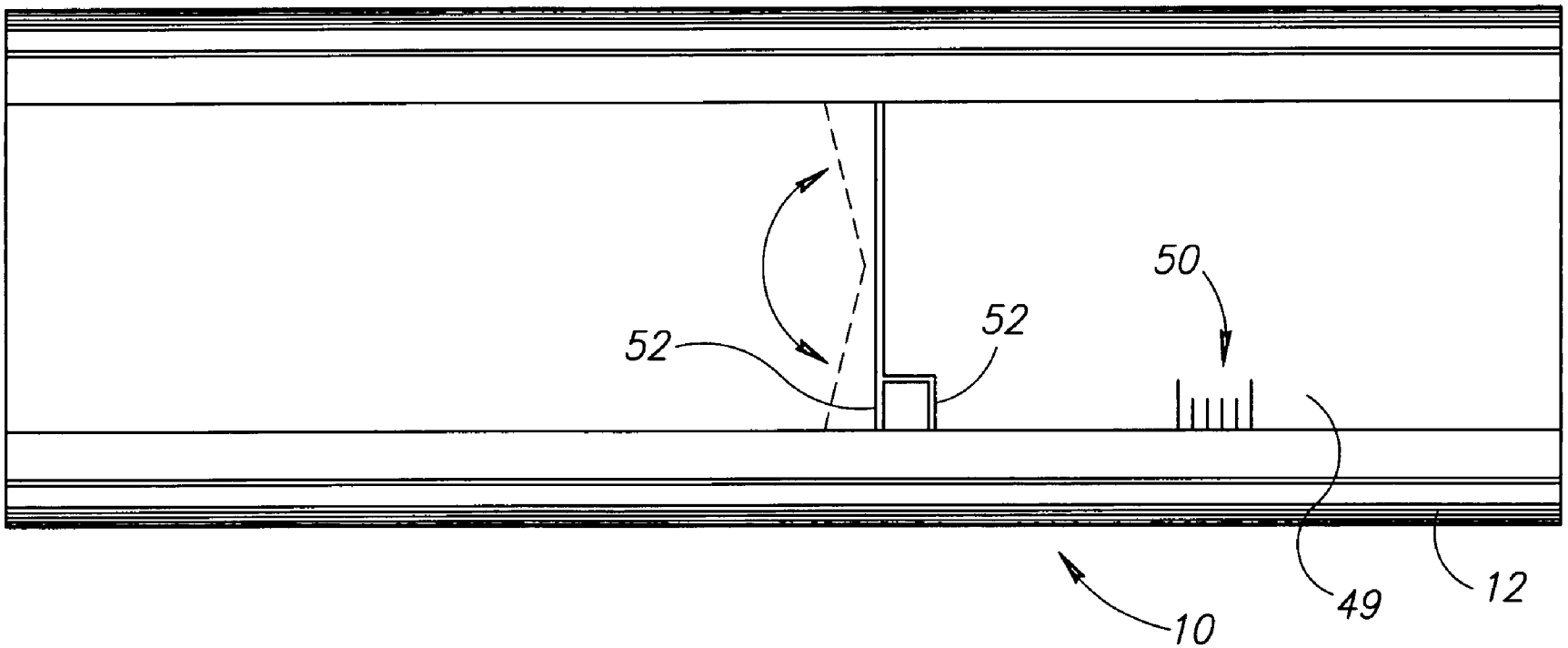
FIG. 5 is a simplified pictorial illustration of a guide bar of the guide clamp of FIG. 1, with angular markings disposed thereon, in accordance with an embodiment of the present invention.

Reference is now made to FIG. 5, which illustrates a topside 49 of guide bar 12 of the guide clamp 10. In accordance with an embodiment of the present invention, dimensional markings, such as ruler markings 50 (e.g., centimeter or inch markings) and/or angular markings 52 (e.g., 30°, 45°, 60°, 90°, etc.) may be marked on guide bar 12. The markings 50 and/or 52 may be printed on guide bar 12 (e.g., silk-screening) or may be etched thereon, or may be formed by any other method (e.g., integrally molded with the guide clamp 10 or formed as a decal or sticker and glued or otherwise bonded on the guide clamp 10).

Figure 6A:
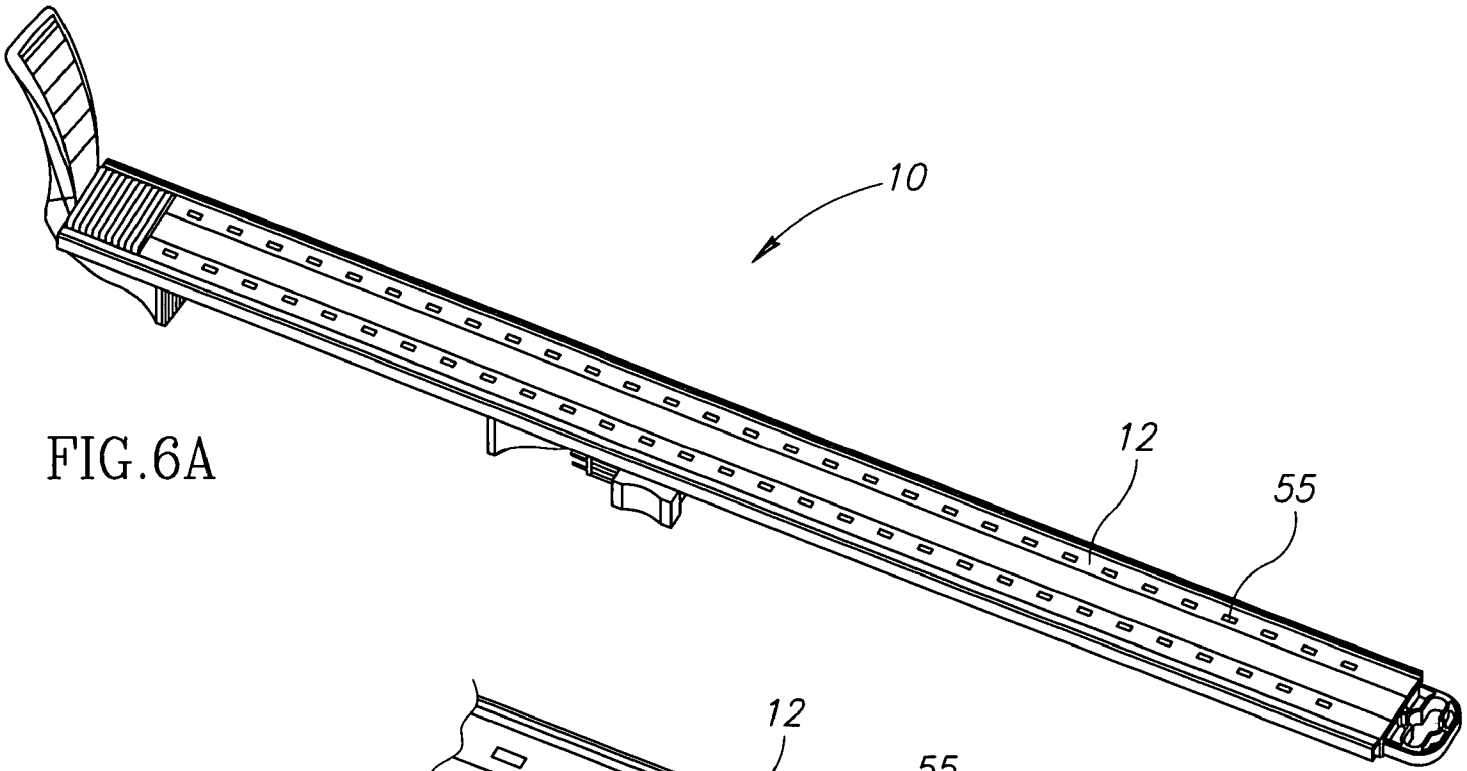
FIGS. 6A and 6B are simplified pictorial and enlarged detail illustrations, respectively, of the guide clamp with perforations for attaching accessories thereto, in accordance with another embodiment of the present invention.
Figure 6B:
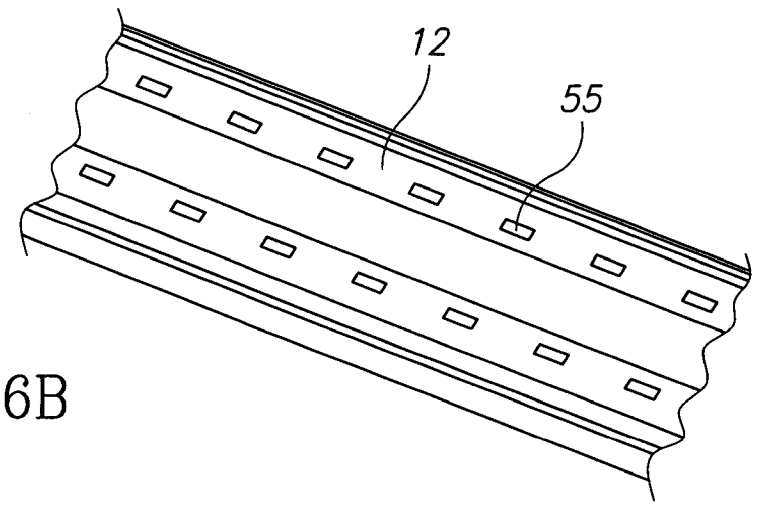

Reference is now made to FIGS. 6A and 6B, which illustrate another possible feature in accordance with another embodiment of the present invention. In the illustrated embodiment, the guide bar 12 has perforations 55 formed therein (e.g., by punching, drilling, molding, etc.), for attaching accessories thereto (e.g., guide tools, holding tools, cutting tools, etc., not shown).

It is appreciated that various features of the invention which are, for clarity, described in the contexts of separate embodiments, may also be provided in combination in a single embodiment. Conversely, various features of the invention which are, for brevity, described in the context of a single embodiment, may also be provided separately or in any suitable subcombination.

What is claimed is:

1. A guide clamp comprising:

a generally, straight elongate guide bar having a generally, straight elongate underside;

a first clamp assembly mounted at one end of said guide bar;

a second clamp assembly slidingly mounted along said guide bar, said clamp assemblies being adapted to clamp a workpiece therebetween;

an end cap affixed to an opposite end of said guide bar;

wherein at least one of said clamp assemblies comprises a clamp jaw face that is pivotable about a pivot that overlies and points generally perpendicular to said underside of said guide bar.

2. The guide clamp according to claim 1, wherein said clamp jaw face remains generally perpendicular to said underside of said guide bar as said clamp jaw face pivots about said pivot.

3. The guide clamp according to claim 1, wherein said clamp jaw face comprises a clamp jaw pad received in a clamp jaw receiving member.

4. The guide clamp according to claim 1, wherein at least one resilient arm extends from said at least one clamp assembly, adapted for providing an urging force on said at least one clamp assembly to return the at least one clamp assembly from a pivoted position to a non-pivoted, straight position.

5. The guide clamp according to claim 4, wherein said at least one resilient arm is arcuate in shape terminating in a curved lip.

6. The guide clamp according to claim 1, wherein dimensional markings are marked on said guide bar.

7. The guide clamp according to claim 6, wherein said dimensional markings comprise at least one of ruler markings and angular markings.

8. The guide clamp according to claim 1, wherein said guide bar is formed with perforations for attaching accessories thereto.

* * * * *